US005685922A

United States Patent [19]

Endou et al.

[11] Patent Number: 5,685,922

[45] Date of Patent: Nov. 11, 1997

[54] CHEMICAL CONVERSION METHOD AND SURFACE TREATMENT AND METHOD FOR METAL CAN

[75] Inventors: Syunichi Endou; Satoshi Miyamoto, both of Osaka, Japan

[73] Assignee: Nippon Paint Co., Ltd., Osaka, Japan

[21] Appl. No.: 444,516

[22] Filed: May 19, 1995

Related U.S. Application Data

[62] Division of Ser. No. 297,757, Aug. 30, 1994, abandoned.

[30] Foreign Application Priority Data

Aug. 31, 1993 [JP] Japan ..... 5-215357
Aug. 31, 1993 [JP] Japan ..... 5-215358

[51] Int. Cl.[6] ..... C23C 22/08; C23C 22/36

[52] U.S. Cl. ..... 148/247; 148/255; 148/257; 148/246; 148/260; 148/273

[58] Field of Search ..... 148/246, 247, 148/260, 257, 273, 255; 252/49.3

[56] References Cited

U.S. PATENT DOCUMENTS 3,661,784 5/1972 Bellos ..... 252/49.3
4,260,499 4/1981 Fern ..... 252/32.5
5,047,095 9/1991 Geke ..... 148/259
5,139,586 8/1992 Das ..... 148/259
5,174,914 12/1992 Gutzmar ..... 252/34
5,458,698 10/1995 Bershas ..... 148/246

FOREIGN PATENT DOCUMENTS 627240 9/1961 Canada ..... 148/262
875972 8/1961 United Kingdom ..... 148/262

*Primary Examiner*—Sam Silverberg
*Attorney, Agent, or Firm*—Townsend & Banta

[57] ABSTRACT

Quaternary ammonium salt having at least one alkyl group of 10 to 20 in carbon number is added to a chemical conversion solution to be at least 20 ppm in concentration, and a chemical conversion coating is formed on a surface of a metal can with this chemical conversion solution. After the chemical conversion coating is formed on the surface of the metal can with the chemical conversion solution, a surface treatment solution containing quaternary ammonium salt having at least one alkyl group of 10 to 20 in carbon number is applied to the surface of the metal can provided with the chemical conversion coating.

2 Claims, No Drawings

CHEMICAL CONVERSION METHOD AND SURFACE TREATMENT AND METHOD FOR METAL CAN

This is a divisional of Application Ser. No. 08/297,757 filed Aug. 30, 1994 now abandoned.

BACKGROUND OF THE INVENTION

1. Field of the Invention

The present invention relates to a chemical conversion method of forming a chemical conversion coating on the surface of a metal can with a chemical conversion solution, and a surface treatment method for a metal can.

2. Description of the Background Art

Metal cans include a two-piece can consisting of a bottomed cylindrical barrel and a top plate, and a three-piece can consisting of a bottomless cylindrical barrel, a base plate and a top plate. The barrels of such metal cans are generally formed by metal plates, which are successively treated in order of preliminary degreasing, degreasing, rinsing, chemical conversion, rinsing, drying and coating after forming. A number of can barrels are carried along a laterally wide line at a high speed and subjected to treatment through the forming step to the drying step, while the width of the line is reduced between the drying step and the coating step so that the can barrels as gathered are carried one by one along the narrowed line. In the coating step, the can barrels which are carried one by one are successively subjected to printing or coating on the outer surfaces thereof.

When the width of the line is reduced as described above, the can barrels as gathered come into contact or collide with each other. Particularly when barrels of aluminum cans having high surface roughness and a high friction coefficient in general are carried at an extremely high speed and gathered together, mobility thereof is so deteriorated that the can barrels, are collapsed or broken due to mutual contact or collision, or sprung out from the conveyer.

Japanese Patent Laying-Open No. 64-85292 (1989) discloses a technique of employing a water-soluble material such as ethylene oxide addition alcohol phosphate, ethylene oxide addition alcohol or ethylene oxide addition fatty acid as a surface treatment agent, applying the same to the outer surfaces of metal cans by spraying or the like for reducing the friction coefficients of the outer surfaces, thereby improving mobility of the cans.

On the other hand, each of Japanese Patent Laying-Open Nos. 3-207766 (1991) and 4-66671 (1992) discloses a technique of employing a surface treatment solution of pH 4 to 6 consisting of polystyrene resin, orthophosphoric acid or condensed phosphoric acid and water and applying the same to the surfaces of can barrels thereby improving sliding quality of the same.

However, the ethylene oxide adduct of fatty acid disclosed in Japanese Patent Laying-Open No. 64-85292 is water-soluble and hence this surface-treatment solution is disadvantageously removed when the can barrels are rinsed after application thereof. Therefore, this surface treatment solution is introduced into water which is employed in the final rinsing step. Thus, the can barrels cannot be completely rinsed and water tends to remain in bottoms or flange portions of the can barrels to leave the component of the surface treatment agent in a condensed state, leading to reduction in film adhesion.

Further, a conveyor for carrying the can barrels cannot be completely rinsed either and hence the same is disadvantageously contaminated by the component of the surface treatment agent adhering thereto.

Further, the surfaces of the cans may have strong water repellency depending on the component of the surface treatment agent, leading to difficulty in handling in later steps.

The ethylene oxide addition alcohol phosphate disclosed in the aforementioned gazette is not completely removed by rinsing but maintains sliding quality due to its adsorptivity to the chemical conversion coatings provided on the surfaces of the metal cans, although the same is water-soluble. However, this surface treatment agent is extremely inferior in film adhesion.

On the other hand, the method disclosed in Japanese Patent Laying-Open No. 3-207766 etc. employs a solution containing resin and therefore requires a specific step in addition to general steps, leading to complicated manufacturing steps. Further, aluminum cans are disadvantageously nigrified when the same are heated by boiling water after coating, leading to inferiority in resistance against the so-called boiling water nigrification.

SUMMARY OF THE INVENTION

An object of the present invention is to provide a chemical conversion method and a surface treatment method for a metal can, which can provide excellent sliding quality to the outer surface of a metal can, and neither reduction of the sliding quality nor reduction of the film adhesion is caused by rinsing.

A chemical conversion method according to a first aspect of the present invention comprises the steps of adding quaternary aluminum salt having at least one alkyl group of 10 to 20 in carbon number to a chemical conversion solution to be at least 20 ppm in concentration, and forming a chemical conversion coating on the surface of a metal can with the chemical conversion solution.

A surface treatment method according to a second aspect of the present invention comprises the steps of forming a chemical conversion coating on the surface of a metal can with a chemical conversion solution, and coating the surface of the metal can, which is provided with the chemical conversion coating, with a surface treatment solution containing quaternary ammonium salt having at least one alkyl group of 10 to 20 in carbon number.

The quaternary ammonium salt employed in each of the first and second aspects of the present invention is not particularly restricted so far as the same has at least one alkyl group of 10 to 20 in carbon number, while this ammonium salt can be prepared from a compound which is expressed in the following formula, for example:

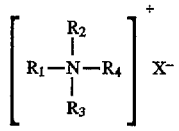

where each of $R_1$ to $R_4$ represents an alkyl group, an alkoxy group or a benzyl group of 1 to 20 in carbon number with at least one of these symbols representing an alkyl group 10 to 20 in carbon number, and X represents Cl, $SO_4$, $NO_3$ or F.

The quaternary ammonium salt employed in each of the first and second aspects of the present invention is preferably about 150 to 800 in molecular weight.

In the first aspect of the present invention, the quaternary ammonium salt is added to the chemical conversion solution in such an amount that the same is at least 20 ppm in concentration. If the concentration of the quaternary ammonium salt is less than 20 ppm, it is impossible to attain a sufficient effect of reducing the friction coefficient of the metal can. Further, the amount of the quaternary ammonium salt is preferably not more than 1000 ppm. If If the amount exceeds 1000 ppm, the metal can may be badly influenced in appearance and quality after drying. The amount of the quaternary ammonium salt is more preferably 50 to 800 ppm, and further preferably 100 to 500 ppm.

The chemical conversion solution to which the quaternary ammonium salt is added in the first aspect of the present invention can be prepared from a generally known one, such as chemical conversion solutions which can form chemical conversion coatings of phosphate and/or fluorine compounds, for example.

Concentration of the quaternary ammonium salt contained in the surface treatment solution which is employed in the second aspect of the present invention is not particularly restricted but appropriately adjusted in response to the method of applying the surface treatment solution. When the surface treatment solution is applied to the surface of the metal can by a general spraying method, the concentration of the quaternary ammonium salt is preferably about 20 to 1000 ppm. If the concentration is less than 20 ppm, it may not be possible to make the surface of the metal can adsorb a sufficient amount of the quaternary ammonium salt. If the surface treatment solution is applied in high concentration exceeding 1000 ppm, on the other hand, the quaternary ammonium salt is adsorbed in such an excess amount that the same may be removed in rinsing or the like, or exert a bad influence on the appearance and quality of the metal can. The concentration of the quaternary ammonium salt is more preferably 50 to 800 ppm, and further preferably 100 to 500 ppm.

The chemical treatment solution employed in the second aspect of the present invention can be prepared from a generally known one, such as chemical treatment solutions which can form chemical conversion coatings of phosphate and/or fluorine compounds, for example.

In each of the first and second aspects of the present invention, the chemical treatment solution preferably contains at least 10 ppm of phosphoric acid ions and/or fluorine ions or complex fluoride ions, and at least 10 ppm of transition metal ions in composition. The transition metal ions can be prepared from zirconium, titanium, hafnium, vanadium and/or cerium. The transition metal ions may be contained as metal cations and complex ions. The content of the phosphoric acid ions and/or fluorine ions or complex fluoride ions is further preferably 10 to 1000 ppm in the chemical treatment solution. The complex fluoride ions can be prepared from silicofluoride ions or borofluoride ions. Both of the fluorine ions and the complex fluoride ions may be contained in the chemical conversion solution. A further preferable content of the transition metal ions of zirconium or the like is 20 to 125 ppm.

In the first aspect of the present invention, the chemical conversion treatment may be carried out a plurality of times. For example, a chemical conversion coating may be formed with a chemical conversion solution containing no quaternary ammonium salt, so that the chemical conversion coating is thereafter subjected to chemical conversion treatment with a chemical conversion solution containing quaternary ammonium salt. It is possible to further improve boiling water nigrification resistance by forming the chemical conversion coating with the chemical conversion solution containing no quaternary ammonium salt as an underlayer coating.

In the first aspect of the present invention, a defoaming agent may be added to the chemical treatment solution at need. Also in the second aspect of the present invention, a defoaming agent may be added to the chemical treatment solution at need. In particular, quaternary ammonium salt having a substitutional group to which ethylene oxide is added tends to cause a problem of foaming, and hence about 0.5 to 3 percent by weight of a defoaming agent may be added to this quaternary ammonium salt. Such a defoaming agent can be prepared from a nonionic surface active agent such as Pluronic type alcohol ethylene oxide propylene oxide adducts, sorbitan fatty acid esters or the like.

According to the first aspect of the present invention, it is possible to form an inorganic-organic composite film comprising a chemical conversion coating which adsorbs quaternary ammonium salt, by adding specific quaternary ammonium salt to a chemical treatment solution and carrying out chemical conversion treatment. The quaternary ammonium salt is so strongly adsorbed by the chemical conversion coating that the same is not removed when the coating is rinsed after the chemical conversion treatment but maintains an effect for serving as lubricant, whereby the treated surface has sliding quality after the rinsing. Further, the sliding quality is still maintained after later treatment such as acid rinsing.

According to the first aspect of the present invention, therefore, it is possible to provide excellent sliding quality so that the coating is not removed by rinsing, thereby improving mobility of the metal can. Further, it is possible to smoothly introduce/take out a mandrel into/from the can barrel for making printing/coating on the metal can, thereby reducing wear of the mandrel.

Further, the chemical conversion coating which is formed according to the first aspect of the present invention has excellent film adhesion.

In addition, the chemical conversion coating which is formed according to the first aspect of the present invention exhibits no water repellency but provides excellent wettability in rinsing, leading to easy handling in later steps.

According to the second aspect of the present invention, a surface treatment solution containing specific quaternary ammonium salt is applied to the surface of a metal can which is provided with a chemical conversion coating, so that the quaternary ammonium salt is adsorbed by the chemical conversion coating.

The quaternary ammonium salt is so strongly adsorbed by the chemical conversion coating that the same is not removed upon rinsing after the surface treatment but maintains an effect for serving as lubricant, whereby the treated surface has sliding quality after the rinsing. Further, the sliding quality is still maintained after later treatment such as acid rinsing.

According to the second aspect of the present invention, therefore, it is possible to provide excellent sliding quality to the coating so that the same is not removed by rinsing, thereby improving mobility of the metal can. Further, it is possible to smoothly introduce/take out a mandrel into/from the can barrel for making printing/coating on the metal can, thereby reducing wear of the mandrel.

In addition, the metal can which is surface-treated according to the second aspect of the present invention has excellent film adhesion. The reason why the surface treatment method according to the second aspect of the present invention provides excellent film adhesion is not yet clarified in detail, but the excellent film adhesion may conceivably result from affinity to a film which is formed thereon.

The foregoing and other objects, features, aspects and advantages of the present invention will become more apparent from the following detailed description of the present invention.

DESCRIPTION OF THE PREFERRED EMBODIMENTS

The first aspect of the present invention is now described with reference to Examples, while the first aspect is not restricted to the following Examples.

EXAMPLE 1

The following beef tallow amine ethylene oxide adduct benzyl chloride was employed as quaternary ammonium salt:

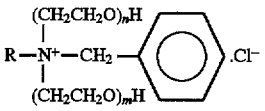

where R represents beef tallow, and n and m represent integers of 1 to 2.

The surface of a barrel of metal can which was prepared by forming an aluminum plate was treated through steps of degreasing, rinsing 1, chemical conversion, rinsing 2, pure water rinsing and drying.

The respective steps are now described.

(Degreasing)

A 3.5 wt. % aqueous solution which was prepared by dissolving a degreasing agent (Surf Cleaner NHC-100 (trade name): concentrated degreasing solution by Nippon Paint Co., Ltd.) in water was sprayed onto the aluminum can barrel at 60° C. for 2 minutes.

(Rinsing 1)

Industrial water was sprayed onto the degreased can barrel at the room temperature for 10 seconds.

(Chemical Conversion)

A solution, which was prepared by adding a 5 wt. % aqueous solution of the surface treatment agent expressed in the aforementioned chemical formula to a 2.5 wt. % aqueous solution which was prepared by dissolving a phosphate treatment solution (Alsurf 4040 (trade name): zirconium phosphate treatment agent by Nippon Paint Co., Ltd.). in water and adjusting the same to pH 3.0 with aqueous ammonia so that quaternary ammonium salt was 20 ppm, was sprayed onto the can barrel, which was rinsed in the rinsing 1 step, at 40° C. for 20 seconds.

(Rinsing 2)

Industrial water was sprayed onto the chemically converted can barrel at the room temperature for 10 seconds.

(Pure Water Rinsing)

Pure water was sprayed onto the can barrel, which was subjected to the rinsing 2 step, at the room temperature for 10 seconds.

(Drying)

The can barrel, which was subjected to the pure water rinsing step, was dried at 200° C. for 2 minutes.

EXAMPLE 2

A metal can was treated similarly to Example 1, except that quaternary ammonium salt was added to be 100 ppm in the chemical conversion step.

EXAMPLE 3

A metal can was treated similarly to Example 1, except that quaternary ammonium salt was added to be 500 ppm in the chemical conversion step.

EXAMPLE 4

A metal can was treated similarly to Example 1, except that quaternary ammonium salt was added to be 1000 ppm in the chemical conversion step.

EXAMPLE 5

A metal can was treated similarly to Example 1, except that the following lauryl dimethylamine benzyl chloride was employed as quaternary ammonium salt to be added to the chemical conversion solution in the chemical conversion step and this quaternary ammonium salt was added to be 500 ppm.

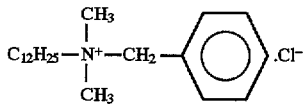

EXAMPLE 6

A metal can was treated similarly to Example 1, except that the following lauryl trimethylammonium chloride was employed as quaternary ammonium salt to be added to the chemical conversion solution in the chemical conversion step and this quaternary ammonium salt was added to be 500 ppm.

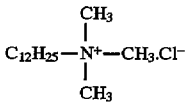

COMPARATIVE EXAMPLE 1

A metal can was treated similarly to Example 1, except that no quaternary ammonium salt was added to the chemical conversion solution in the chemical conversion step.

COMPARATIVE EXAMPLE 2

A metal can was treated similarly to Example 1, except that no quaternary ammonium salt was added to the chemical conversion solution but an isostearic acid ethylene oxide adduct (Ethox MI-14 (trade name) by Ethox Co., Ltd.) was added to be 500 ppm in the chemical conversion step.

COMPARATIVE EXAMPLE 3

A metal can was treated similarly to Example 1, except that no quaternary ammonium salt was added to the chemical conversion solution but an ester phosphate ethylene oxide adduct (Gafac PE510 (trade name) by Phone-Poulenc/GAF) was added to be 500 ppm in the chemical conversion step.

The metal cans of Examples 1 to 6 and comparative examples 1 to 3 obtained in the aforementioned manners were subjected to evaluation of friction coefficients, states after rinsing and adhesion values after coating.

The friction coefficients were measured by a Haydon rubbing tester (with a load of 250 g and roller fixation of 100 mm/min.).

The adhesion values after coating were evaluated on coatings which were formed by applying epoxyacrylic paints by a bar coater to be 4 μm in thickness and drying the same in atmosphere of 250° C. for 30 seconds. Primary adhesion was evaluated by a 1 mm cross-cut adhesion test after coating, Secondary adhesion was evaluated by a 1 mm cross-cut adhesion test after dipping samples in boiling water for 30 minutes.

The states after rinsing were visually observed.

Table 1 shows the results of measurement.

TABLE 1

| | Concentration (ppm) | Friction Coefficient | State after Rinsing | Adhesion after Coating Primary | Adhesion after Coating Secondary |
|---|---|---|---|---|---|
| Example 1 | 20 | 0.60 | Wettable | 100/100 | 100/100 |
| Example 2 | 100 | 0.41 | Wettable | 100/100 | 100/100 |
| Example 3 | 500 | 0.21 | Wettable | 100/100 | 100/100 |
| Example 4 | 1000 | 0.22 | Wettable Partially Water-Repellent | 100/100 | 100/100 |
| Example 5 | 500 | 0.30 | Wettable | 100/100 | 100/100 |
| Example 6 | 500 | 0.43 | Wettable | 100/100 | 100/100 |
| Comparative Example 1 | 0 | 0.89 | Wettable | 100/100 | 100/100 |
| Comparative Example 2 | 500 | 0.88 | Wettable | 100/100 | 100/100 |
| Comparative Example 3 | 500 | 0.26 | Water-Repellent | 0/100 | 0/100 |

It is clearly understood from Table 1 that the metal cans of Examples 1 to 6 according to the first aspect of the present invention exhibit low friction coefficients, with excellent sliding quality. It is also understood that these metal cans can be surface-treated in states having low water repellency also after rinsing. Further, the metal cans surface-treated according to the first aspect of the present invention have excellent film adhesion, as clearly understood from the results of adhesion after coating.

Description is now made on Examples of carrying out chemical conversion treatment twice for adding quaternary ammonium salt in the second chemical conversion treatment.

EXAMPLE 7

A can barrel of a metal can obtained by forming an aluminum plate was continuously carried so that its surface was treated through steps of degreasing, rinsing 1, chemical conversion 1, chemical conversion 2, rinsing 2, pure water rinsing and drying.

The degreasing, rinsing 1, rinsing 2, pure water rinsing and drying steps were carried out similarly to those of Example 1. The chemical conversion 2 step was also carried out by adding quaternary ammonium salt to be 20 ppm, similarly to the chemical conversion step of Example 1. In the chemical conversion 1 step, chemical conversion was carried out with a chemical conversion solution containing no quaternary ammonium salt, similarly to conventional treatment.

(Chemical Conversion 1)

A 2.5 wt. % aqueous solution, which was prepared by dissolving a phosphate treatment solution (Alsurf 4040 (trade name)) in water and adjusting the same to pH 3.0 with aqueous ammonia, was sprayed onto the can barrel at 40° C. for 20 seconds.

EXAMPLE 8

A metal can was treated similarly to Example 7, except that quaternary ammonium salt was added to be 100 ppm in the chemical conversion 2 step.

EXAMPLE 9

A metal can was treated similarly to Example 7, except that quaternary ammonium salt was added to be 500 ppm in the chemical conversion 2 step.

EXAMPLE 10

A metal can was treated similarly to Example 7, except that quaternary ammonium salt was added to be 1000 ppm in the chemical conversion 2 step.

COMPARATIVE EXAMPLE 4

A metal can was treated similarly to Example 7, except that no quaternary ammonium salt was added to the chemical conversion solution but an isostearic acid ethylene oxide adduct (Ethox MI-14 (trade name) by Ethox Co., Ltd.) was added to be 500 ppm.

COMPARATIVE EXAMPLE 5

A metal can was treated similarly to Example 7, except that no quaternary ammonium salt was added to the chemical conversion solution but a phosphoric acid ester ethylene oxide adduct (Gafac PE510 (trade name) by Phone-Poulenc/GAF) was added to be 500 ppm.

The metal cans of Examples 7 to 10 and comparative examples 4 and 5 obtained in the aforementioned manners were subjected to evaluation of friction coefficients, states after rinsing and adhesion values after coating, similarly to Examples 1 to 6. Table 2 shows the results.

TABLE 2

| | Concentration (ppm) | Friction Coefficient | State after Rinsing | Adhesion after Coating Primary | Adhesion after Coating Secondary |
|---|---|---|---|---|---|
| Example 7 | 20 | 0.56 | Wettable | 100/100 | 100/100 |
| Example 8 | 100 | 0.30 | Wettable | 100/100 | 100/100 |
| Example 9 | 500 | 0.21 | Wettable | 100/100 | 100/100 |
| Example 10 | 1000 | 0.20 | Frange Partially Water-Repellent | 100/100 | 100/100 |
| Comparative Example 4 | 500 | 0.86 | Wettable | 100/100 | 100/100 |
| Comparative Example 5 | 500 | 0.27 | Water-Repellent | 0/100 | 0/100 |

It is clearly understood from Table 1 that the metal cans of Examples 7 to 10 which were chemically converted according to the first aspect of the present invention exhibit low friction coefficients with excellent sliding quality as well as excellent adhesion after coating.

The second aspect of the present invention is now described with reference to Examples, while the second aspect is not restricted to the following Examples.

EXAMPLE 11

The same beef tallow amine ethylene oxide adduct benzyl chloride as that employed in Example 1 was used as quaternary ammonium salt.

The surface of a can barrel of a metal can which was prepared by forming an aluminum plate was treated through steps of degreasing, rinsing 1, chemical conversion, surface treatment, rinsing 2, pure water rinsing and drying.

The respective steps are now described.

(Degreasing)

A 3–5 wt. % aqueous solution which was prepared by dissolving a degreasing agent (Surf Cleaner NHC-100 (trade name): concentrated degreasing solution by Nippon Paint Co., Ltd.) in water was sprayed onto the aluminum can barrel at 60° C. for 2 minutes.

(Rinsing 1)

Industrial water was sprayed onto the degreased can barrel at the room temperature for 10 seconds.

(Chemical Conversion)

A2.5 wt. % aqueous solution, which was prepared by dissolving a phosphate treatment solution (Alsurf 4040 (trade name): zirconium phosphate treatment agent by Nippon Paint Co., Ltd.) in water and adjusting the same to pH 3.0 with aqueous ammonia, was sprayed onto the can barrel, which was rinsed in the rinsing 1 step, at 40° C. for 20 seconds.

(Surface Treatment)

A 1 wt. % aqueous solution of the aforementioned quaternary ammonium salt was sprayed onto the can barrel at the room temperature for 20 seconds.

(Rinsing 2)

Industrial water was sprayed onto the chemically converted can barrel at the room temperature for 10 seconds.

(Pure Water Rinsing)

Pure water was sprayed onto the can barrel, which was subjected to the rinsing 2 step, at the room temperature for 10 seconds.

(Drying)

The can barrel, which was subjected to the pure water rinsing step, was dried at 200° C. for 2 minutes.

EXAMPLE 12

A metal can was treated similarly to Example 11, except that the lauryl dimethylamine benzyl chloride employed in Example 5 was used as quaternary ammonium salt to be added in the surface treatment step.

EXAMPLE 13

A metal can was treated similarly to Example 11, except that the lauryl trimethylammonium-chloride employed in Example 6 was used as quaternary ammonium salt to be added in the surface treatment step.

COMPARATIVE EXAMPLE 6

A metal can was treated similarly to Example 11, except that no surface treatment was made but the rinsing 2 step was carried out immediately after the chemical conversion step.

COMPARATIVE EXAMPLE 7

A metal can was treated similarly to Example 11, except that a 1 wt. % aqueous solution of an isostearic acid ethylene oxide adduct (Ethox MI-14 (trade name) by Ethox Co., Ltd.) was employed in place of quaternary ammonium salt in the surface treatment step.

COMPARATIVE EXAMPLE 8

A metal can was treated similarly to Example 11, except that a 1 wt. % aqueous solution of an ester phosphate ethylene oxide adduct (Gafac PE510 (trade name) by Phone-Poulenc/GAF) was employed in place of quaternary ammonium salt in the surface treatment step.

The metal cans of Examples 11 to 13 and comparative examples 6 to 8 obtained in the aforementioned manners were subjected to evaluation of friction coefficients, states after rinsing and adhesion values after coating.

The friction coefficients were measured by a Haydon rubbing tester (with a load of 250 g and roller fixation of 100 mm/min.).

Adhesion values after coating were evaluated on coatings which were formed by applying epoxyacrylic paints by a bar coater to be 4 μm in thickness and drying the same in atmosphere of 250° C. for 30 seconds. Primary adhesion was evaluated by a 1 mm cross-cut adhesion test after coating. Secondary adhesion was evaluated by a 1 mm cross-cut adhesion test after dipping samples in boiling water for 30 minutes.

The states after rinsing were visually observed.

Table 3 shows the results of measurement.

TABLE 3

| | Friction | Adhesion After Coating | |
|---|---|---|---|
| | Coeficient | Primary | Secondary |
| Example 11 | 0.21 | 100/100 | 100/100 |
| Example 12 | 0.30 | 100/100 | 100/100 |
| Example 13 | 0.43 | 100/100 | 100/100 |
| Comparative Example 6 | 0.88 | 100/100 | 100/100 |
| Comparative Example 7 | 0.87 | 100/100 | 100/100 |
| Comparative Example 8 | 0.28 | 0/100 | 0/100 |

It is clearly understood from Table 3 that the metal cans of Examples 11 to 13 according to the second aspect of the present invention exhibit low friction coefficients, with excellent sliding quality. Further, the metal cans which were surface-treated according to the second aspect of the present invention have excellent film adhesion, as clearly understood from the results of adhesion after coating.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A surface treatment method for a metal can comprising the steps of:

first forming a chemical conversion coating on a surface of said metal can with a chemical conversion solution, said chemical conversion solution containing at least 10 ppm of phosphoric acid ions and/or fluorine ions or complex fluoride ions, and at least 10 ppm of at least one type of metal ions selected from the group consisting of zirconium, titanium, hafnium, vanadium and cerium;

then treating said metal can having said chemical conversion coating with a surface treatment solution containing a mixture of said chemical conversion solution and a quaternary ammonium salt having at least one alkyl group with 10 to 20 carbon atoms, wherein said quaternary ammonium salt has the following formula

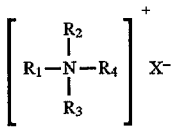
where each of $R_1$ to $R_4$ represents an alkyl group, an alkoxy group or a benzyl group with 1 to 20 carbon atoms, at least on of $R_1$ to $R_4$ represents an alkyl group with 10 to 20 carbon atoms, and X represents Cl, $SO_4$, $NO_3$ or F.
2. A surface treatment method for a metal can in accordance with claim 1, wherein the content of said quaternary ammonium salt is 20 to 1000 ppm.
* * * * *